United States Patent [19]

Chang

[11] 4,319,746

[45] Mar. 16, 1982

[54] ROTATABLE SEESAW DEVICE

[76] Inventor: Edmond Chang, 3F.79 Nin-Po West St., Taipel, Taiwan

[21] Appl. No.: 162,181

[22] Filed: Jun. 23, 1980

[30] Foreign Application Priority Data

May 8, 1980 [TW] Taiwan ..... 69/22164

[51] Int. Cl.[3] ..... A63G 1/32

[52] U.S. Cl. ..... 272/30

[58] Field of Search ..... 272/30, 54

[56] References Cited

U.S. PATENT DOCUMENTS

| | | | |
|---|---|---|---|
| 1,069,715 | 8/1913 | Morris | 272/30 |
| 1,396,247 | 11/1921 | Bowman | 272/30 |
| 1,465,662 | 8/1923 | Fields et al. | 272/30 |
| 1,769,199 | 7/1930 | Baxter | 272/30 |
| 2,551,720 | 5/1951 | Bevis | 272/54 X |
| 2,835,491 | 5/1958 | Meyers | 272/30 |
| 3,529,817 | 9/1970 | Hirst | 272/54 |

FOREIGN PATENT DOCUMENTS

| | | | |
|---|---|---|---|
| 26521 | 7/1906 | Austria | 272/54 |
| 5763 | of 1902 | United Kingdom | 272/54 |

*Primary Examiner*—Richard J. Apley
*Assistant Examiner*—Arnold W. Kramer
*Attorney, Agent, or Firm*—Darby & Darby

[57] ABSTRACT

A rotatable seesaw device comprises a seesaw lever arm supported by an upstanding supporting structure through a pivotal arrangement in such a manner that rotating motion about the upstanding support structure can be produced as force in peripheral direction is applied and that seesaw motion can be produced by exerting force in vertical direction. The upstanding support structure is detachable and the height thereof can be adjusted to various users such as children or adults. Further, the middle portion of the seesaw lever arm is provided with a plurality of mounting holes spaced along its length and the seesaw lever arm can be supported by the upstanding support structure at selected one of the plurality of mounting holes in order to balance the loading of different weights on opposite ends of the seesaw lever arm, thus the seesaw device can be adapted to be used by persons of different weights. With such arrangement, particularly when force including components in vertical direction and in peripheral direction is applied, rotating motion and seesaw motion can be simultaneously effected to provide a complex, resultant waveform motion around the upstanding support structure, which gives satisfactory thrill and amusement to the users.

5 Claims, 3 Drawing Figures

ROTATABLE SEESAW DEVICE

BACKGROUND OF THE INVENTION

This invention relates to a rotatable seesaw device.

As is known, conventional seesaw arrangement generally includes a lever arm which is provided with seats at opposite ends and is supported at center in such a manner that seesaw motion can be effected as force in vertical direction is applied to either end of the lever arm. Since the lever arm is conventionally supported at its center by an upstanding support means having a fixed height, the seesaw motion can only be produced within a fixed range of height at one fixed position. Thus, conventional seesaw arrangement suffers from the disadvantage of monotonous functioning and performance.

SUMMARY OF THE INVENTION

It is an object of this invention to provide a novel and improved seesaw device which eleminates the abovementioned disadvantages of conventional art.

More specifically, the seesaw device according to this invention comprises a seesaw lever arm supported by an upstanding support means through a pivotal arrangement in such a manner that rotating motion about the upstanding support means can be produced as force in peripheral direction is applied and that seesaw motion can be produced by exerting force in vertical direction. The upstanding support means is detachable and the height thereof can be adjusted to various users such as children or adults. Further the middle portion of the seesaw lever arm is provided with a plurality of mounting holes spaced along its length and the seesaw lever arm can be supported by the upstanding support means at selected one of the plurality of mounting holes in order to balance the loading of different weights on opposite ends of the seesaw lever arm, thus the seesaw device can be adapted to be used by persons of different weights. With such arrangement, particularly when force including components, in vertical direction and in peripheral direction is applied, rotating motion and seesaw moton can be simultaneously effected to provide a complex, resultant waveform motion around the upstanding support means, which gives satisfactory thrill and amusement to the users.

DETAILED DESCRIPTION OF PREFERRED EMBODIMENT OF THE INVENTION

Figure 1:
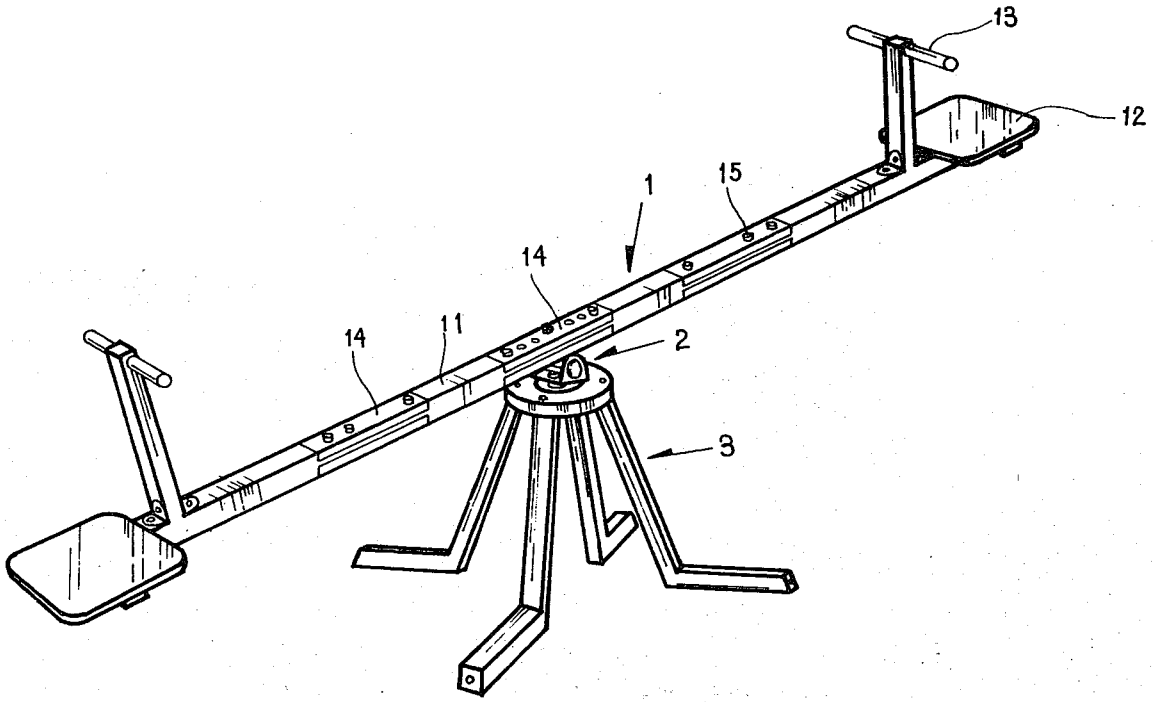
FIG. 1 is a perspective view illustrating an embodiment of the rotatable seesaw device according to this invention.
Figure 3:
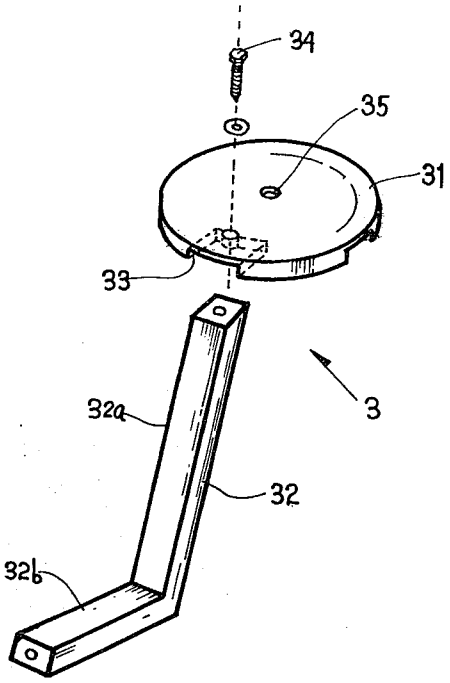
FIG. 3 is an exploded perspective view schematically illustrating the upstanding support means of the rotatable seesaw device of FIG. 1.
Figure 2:
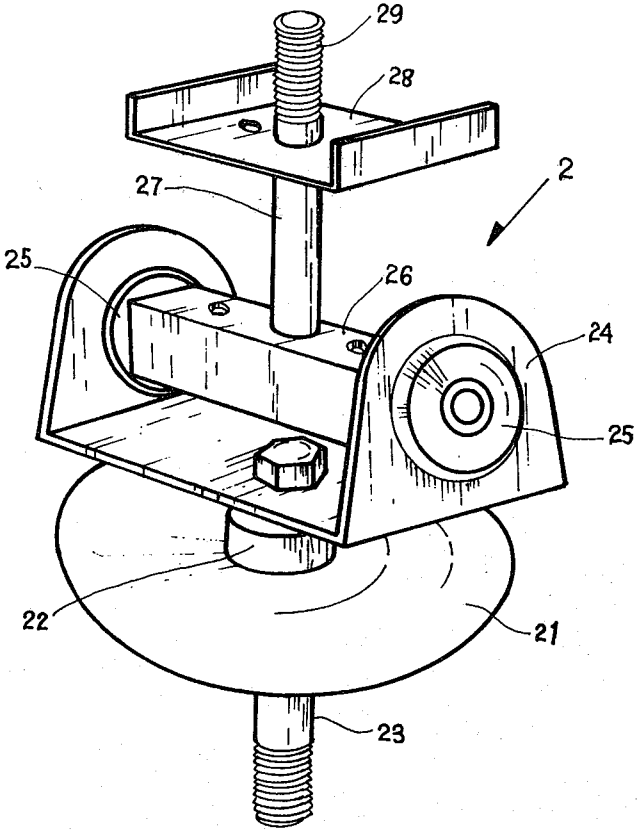
FIG. 2 is a perspective view illustrating, at enlarged scale, the pivotal arrangement of the rotatable seesaw device of FIG. 1.

Referring to FIGS. 1–3, there is shown a preferred embodiment of the rotatable seesaw device according to this invention. As shown in FIG. 1 the rotatable seesaw device generally comprises a seesaw body 1 including lever arm 11, seats 12 and handgrips 13 provided at opposite ends of the lever arm 11, upstanding support means 3 and a pivotal arrangement 2 for mounting the lever arm 11 onto the upstanding support means 3 in order to permit seesaw motion and free rotation of the seesaw body 1 about the vertical axis of the upstanding support means 3. The seesaw body 1 including lever arm 11, seats 12 and handgrips 13 and the upstanding support means 3 may be constructed of wooden material, and the pivotal arrangement 2 is constructed of metal material and includes pivot bolts journaled by ball bearings as will be described hereinafter.

The arrangement of lever arm 11, seats 12 and handgrips 13 is similar to conventional seesaw in their general appearance except that the lever arm 11 according to this invention possesses two novel features in structure. That is, the middle portion of the lever arm 11 according to this invention is provided with a plurality of mounting holes spaced along its length for the user to adjust the distances between the fulcrum point and the ends of the lever arm 11 and thus to balance the loading of different weights on opposite ends of the lever arm; and, for easy and convenient packing, shipment and transportation, the lever arm 11 according to this invention is divided into three sections of equal lengths, and these three sections can be reassembled into one integral structure for use by suitable method. As to the suitable method for reassembling these three sections, it has been found that there are two kinds of methods capable of providing high degree of structural rigidity and strength: the first one includes the steps of punching a thick iron plate to form an engagement plate 14 having U-shaped cross section and through-holes, forming through-holes 15 in the lever arm 11 in adjacency to the abutment areas of these three sections, the through-holes 15 being in alignment with the through-holes in the engagement plate 14 when assembling, and securing the abutting lever arm sections to the upper and lower U-shaped engagement plates 14 which are arranged to hold and clamp the lever arm sections, by means of screw bolts extending through the through-holes of the lever arm and the engagement plates; and, the second one, similar to K/D method for assembling furniture, includes the steps of preparing the middle section as a wooden bar having two threaded nuts of cylindrical shape embedded within both of its end portions, preparing the left and right sections as strip-shaped boards (Such as veneer boards of suitable thickness) of suitable width having two wooden bars parallelly secured onto their undersurfaces, the lengths of the parallel wooden bars being equal to the length of the strip-shaped boards and the distance between these two parallel wooden bars being adapted to snugly receive the end of the middle section, inserting the ends of the middle section into the space defined between these two parallel wooden bars on the undersurfaces of the left and right sections, and securing the left and right sections to the ends of the middle section with screw bolts extending through the stripshaped board into engagement with the cylindrical-shaped nuts embedded in the middle section.

Turning to FIG. 2, there is shown an enlarged perspective view of the pivotal arrangement 2 in the seesaw device of FIG. 1. The feature of multidirectional-motion functioning of the seesaw device according to this invention is resulted from the particular structure of the pivotal arrangement 2. Therefore, the pivotal arrangement 2 is the most important part of this invention. Besides, the multidirectional-motion functioning, the pivotal arrangement 2 further provides the function of support and connection, i.e., supporting and connecting the lever arm 11 thereabove while connecting the upstanding support means 3 therebelow, to form a complete seesaw device as shown in FIG. 1.

As best shown in FIG. 2, the pivotal arrangement 2 includes a generally U-shaped bracket 24 punched from a thick iron plate. Each of the vertical walls of the U-shaped bracket 24 is provided with a ball bearing 25, the axial lines of the bearings 25 being in alignment with one another. More specifically, each of the vertical walls of the U-shaped bracket 24 is provided with a circular opening and the area of the vertical wall around the circular opening is punched and drawn to enlarge the circular opening by making use of the ductility property of the iron plate, such that the circular opening is adapted to snugly receive a ball bearing 25. As the area of the vertical wall around the circular opening is drawn to enlarge the circular opening, the area around the circular opening is drawn inwardly to form a small section of tubular shape, so that there is provided a suitable surface for receiving the ball bearing 25. A pivotal bolt 26 horizontally extends between the vertical walls of the U-shaped bracket 24 with the cylindrical ends of the pivotal bolt 26 journaled in the ball bearings 25 so that the pivotal bolt 26 can freely rotate about its axis. In this arrangement, the ends of the pivotal bolt 26 are received within respective central holes of the ball bearing 25, and the ends of the pivotal bolt 26 are formed into tubular shape and are expanded after being inserted into the central holes of the ball bearings 25 so as to firmly engage the ball bearings 25 and thus prevent unintentional removal or loosing of the ball bearings 25.

The pivotal bolt 26 includes a flat surface facing upward and a vertical stud bolt 27 is connected to the center of the pivotal bolt 26 in the flat surface, the free end of the stud bolt 27 being provided with thread 29. A pad member 28 of U-shaped cross section has a through-hole at the center of its bottom, and the pad member 28 is fitted onto the flat surface of the pivotal bolt 26 with the stud bolt 27 extending through the through-hole of the pad member 28. On the opposite sides of the stud bolt 27, there are provided two recesses in the flat surface of the pivotal bolt 26, and the undersurface of the pad member 28 is provided with two protuberances corresponding to said two recesses, so that when the pad member 28 is fitted onto the pivotal bolt 26 for receiving the lever arm 11, these two protuberances of the pad member 28 engage with the recesses in the flat surface of the pivotal bolt 26.

When assembling, the lever arm 11 is arranged extending in a direction transverse to the axis of the pivotal bolt 26 and being received within the channel defined by the U-shaped pad member 28, while the stud bolt 29 extending through one of the mounting holes provided in the middle portion of the lever arm 11, and then the lever arm 11 is fixed to the pivotal bolt 26 by screwing a nut onto the threaded end 29 of the stud bolt 27, as shown in FIG. 1. Therefore, when upward or downward force is applied to opposite ends of the lever arm 11, the pivotal bolt 26 will be caused to effect reciprocal rotation so as to achieve the seesaw motion of the lever arm 11. The pivotal arrangement 2 further includes a hexagon head pivotal bolt 23 which extends downwardly through a central hole in the bottom surface of the U-shaped bracket 24 with the hexagon head of the pivotal bolt 23 resting against the bottom surface of the bracket 24 as shown in FIG. 2. The pivotal bolt 23 extends through a ball bearing 22 mounted in a pad member 21 which is arranged to rest on a disc member 31 of the upstanding support means 3, and the free end of the pivotal bolt 23 is then connected to the disc member 31 of the upstanding support means 3 (the upstanding support means 3 will be further described hereinafter). i.e., the pivotal bolt 23 extends sequentially through U-shaped bracket 24, ball bearing 22, pad member 21 and disc member 31 and then engages with a nut, so that the pivotal arrangement 2 is assembled together with the upstanding support means 3. Thus, the weight of the lever arm 11 positioned on the pad member 28 over the horizontal pivotal bolt 26 is supported by the U-shaped bracket 24 and the U-shaped bracket 24 is in turn supported by the ball bearing 22. Therefore, when force in peripheral direction is applied, the pivotal bolt 23 will be caused to effect rotation about its axis, so as to achieve the rotation of the lever arm 11 around the upstanding support means 3. It is noted that, with such pivotal arrangement 2, the seesaw device according to this invention is capable of effecting seesaw motion and rotating motion, particularly the seesaw motion and rotating motion can be simultaneously produced to provide a complex, resultant waveform motion around the upstanding support means 3, which gives satisfactory thrill and amusement to the users.

Now referring to FIG. 3, there is shown an exploded perspective view schematically illustrating the upstanding support means 3 in the seesaw device of FIG. 1. The upstanding supporting means 3 includes a disc member 31 and four L-shaped supporting legs 32, but only one supporting leg 32 is shown in FIG. 3 for simplification. The disc member 31 is provided with a central hole 35 for the pivotal bolt 23 to extend therethrough to connect the pivotal arrangement 2 so as to support the weight of the seesaw body 1. Each L-shaped supporting leg 32 consists of two sections **32*a* and 32*b*, these two sections 32*a* and 32*b* being of different lengths and having cylindrical-shaped nuts provided with their free ends. So that either end of the supporting leg 32 can be inserted into a recess 33 provided in the undersurface of the disc member 31 and be secured thereto by a screw 34 which extends through the disc member 31 to engage with the cylindrical-shaped nut within the end of the supporting leg 32 engaging with the recess 33. In this menner, these four supporting legs 32 may be detachably fixed to the disc member 31 as shown in FIG. 1. It should be noted that, as sections 32*a* and 32*b* of each supporting leg 32 has different lengths, the supporting legs 32 may be fixed to the disc member 31 either by their ends of section 32*a* or by their ends of the section 32*b* so as to present two kinds of height for the upstanding support means 3. Therefore, the height of the upstanding support means 3** and thus the height of the seesaw device can be adjusted, if desired.

From the above description, the structural and functional features and advantages of the seesaw device according to this invention may be summarized as follows:

(i) The seesaw body 1 can be caused to effect rotating motion and seesaw body 1 can be caused to effect rotating motion and seesaw motion simultaneously, thus the rotating plane of the seesaw body 1 is not limited to lie in horizontal plane, i.e. the orientation of the rotating plane of the seesaw body 1 is variable at any moment;

(ii) The plurality of mounting holes in the middle portion of the lever arm 11 permit adjustment to balance the loading of weights on opposite ends of the lever arm 11, so as to facilitate smooth operation by the user;

(iii) The upstanding support means 3 may be adjusted to present either kind of height for users of different height, in other words, the seesaw device can be used extensively and the seesaw device is suitable to be used for a prolonged period in spite of the growing-up of the user (i.e. the growing-up of a child);

(iv) The lever arm 11 consists of three detachable sections, and the handgrips and supporting legs 32 are also made detachable in order to facilitate ready packing, transportation and storage, and thus to increase the mobility of the seesaw device so that the seesaw device can be used indoors or outdoors;

(v) The rotating parts are journaled by means of ball bearings so that the seesaw device can operate calmly without noise.

Since the seesaw device according to this invention possesses so many kinds of function and features, the seesaw device of this invention is ready to eliminate the disadvantages of conventional seesaw arrangement and is ready to present as a novel and successful product in market.

It is noted that, for the reason of cost down, plain bearings can be used instead of the ball bearings, but in this case the rotating parts of the pivotal arrangement 2 should be always lubricated with suitable lubricant to prevent the occurence of noise.

I claim:

1. A rotatable seesaw device comprising:

a seesaw body including a lever arm adapted to be supported at its mid-portion and a seating portion provided at each end of the lever arm, an upstanding vertical support means, a pivotal arrangement for mounting said lever arm on said upstanding support means, including:

(a) a first pivotal means having a U-shaped bracket with vertical walls, bearing means in each of said vertical walls, a horizontal pivot bolt having its ends mounted in said bearing means, a vertically extending stud bolt having one end mounted on said horizontal pivot bolt and the other end being connected to said middle portion of said lever arm to function as a fulcrum point and to permit the seesaw motion of the lever arm; and (b) a second pivotal means having a vertical bolt connected to said upstanding vertical support means and to the center leg of said U-shaped bracket, bearing means in one of said vertical support means and said U-shaped bracket means to permit rotational movement of the lever arm relative to said vertical support means, said first and second pivotal means providing simultaneous seesaw and rotating motion with a complex waveform resultant motion when force including components in the vertical and peripheral directions is applied to said lever arm.

2. The rotatable seesaw device as defined in claim 1, wherein the second pivotal bolt means includes a vertical pivotal bolt which is journalled in a ball bearing provided in the top of the upstanding support means.

3. The rotatable seesaw device as defined in claim 1, wherein the middle portion of the lever arm is provided with a plurality of mounting holes for accepting the vertically extending stud bold of said first pivotal means for adjusting the loading on opposite ends of the lever arm.

4. The rotatable seesaw device as defined in claim 1, wherein the upstanding support means includes a horizontal disc member and a plurality of supporting legs each having a substantially L-shaped configuration of two sections of different lengths, either ends of these supporting legs being adapted to fix to the disc member such that the upstanding support means can present two different heights.

5. The rotatable seesaw device as defined in claim 1, further comprising a handgrip at each end of the lever arm.

* * * * *